US005678893A

United States Patent [19]

Bock

[11] Patent Number: 5,678,893

[45] Date of Patent: Oct. 21, 1997

[54] CHAIR, IN PARTICULAR OFFICE CHAIR, WITH AN ADUSTABLE HEIGHT BACK-REST CONSTRUCTION

[75] Inventor: Hermann Bock, Postbauer-Heng, Germany

[73] Assignee: Martin Bock Kunststoffverarbeitung, Postbauer-Heng, Germany

[21] Appl. No.: 645,609

[22] Filed: May 14, 1996

[30] Foreign Application Priority Data

May 17, 1995 [DE] Germany ..... 295 08 082 U

[51] Int. Cl.[6] ..... B60N 2/02

[52] U.S. Cl. ..... 297/353; 297/411.36

[58] Field of Search ..... 297/353, 411.36

[56] References Cited

U.S. PATENT DOCUMENTS

| | | | |
|---|---|---|---|
| 4,012,158 | 3/1977 | Harper | 297/343 X |
| 4,451,084 | 5/1984 | Seeley | 297/353 |
| 4,456,298 | 6/1984 | Gottstein | 297/353 |
| 4,660,885 | 4/1987 | Suhr et al. | 297/353 |
| 4,662,682 | 5/1987 | Maurel | 297/353 |
| 5,265,938 | 11/1993 | Melhuish et al. | 297/411.36 |
| 5,536,070 | 7/1996 | Lemmen | 297/411.36 X |

*Primary Examiner*—Peter M. Cuomo
*Assistant Examiner*—Stephen Vu
*Attorney, Agent, or Firm*—Browdy and Neimark

[57] ABSTRACT

A chair, in particular an office chair, with an adjustable-height back-rest construction, comprises a vertical back-rest support fixed to a chair stand, a back-rest guided on the back-rest support for vertical displacement in the direction of height adjustment and having a preferably upholstered back-rest shell of ergonomic shape, and a manually operated locking mechanism acting between the back-rest support and the back-rest shell for the back-rest shell to be fixed in place on the back-rest support in positions of varying height, wherein at least one vertical row of locking projections is disposed on the back-rest shell, forming between themselves locking recesses, at least one locking slide is guided on the back-rest support for displacement at right angles to the direction of height adjustment, and releasably engages with one of the locking recesses for a position in height of the back-rest to be fixed, and a manually operated actuating slide is guided on the back-rest support for displacement parallel to the direction of height adjustment, the actuating slide being coupled with the at least one locking slide by way of a tapered sliding transmission.

12 Claims, 4 Drawing Sheets

CHAIR, IN PARTICULAR OFFICE CHAIR, WITH AN ADUSTABLE HEIGHT BACK-REST CONSTRUCTION

BACKGROUND OF THE INVENTION

1. Field of the Invention

The invention relates to a chair, in particular an office chair, having an adjustable-height back-rest construction, comprising a vertical back-rest support fixed to a chair stand, a back-rest guided on the back-rest support for vertical displacement in the direction of height adjustment and having a preferably upholstered back-rest shell of ergonomic shape, and a manually operated locking mechanism acting between the back-rest support and the back-rest shell for the back-rest shell to be fixed in place on the back-rest support in positions of varying height.

2. Background Art

Office chairs are generally known to have the adjustable-height back-rest constructions mentioned at the outset, for the purpose of adjusting the position of the back-rest to the height of the user and of improving the ease and convenience of sitting; as a role, these adjustable-height back-rest constructions have a vertical back-rest support fixed to a chair stand, a back-rest guided for vertical displacement on the back-rest support and comprising a preferably upholstered back-rest shell of ergonomic shape, and a locking mechanism to be manually actuated, which is provided between the back-rest support and the back-rest shell for fixing the back-rest shell on the back-rest support in positions of varying height.

SUMMARY OF THE INVENTION

With adjustable-height back-rest constructions of the generic type, a fundamental demand resides in combining ease of assembly with the lowest possible constructional requirements, this being accompanied with excellent conditions of handling the height adjustment system.

These problems are solved by a construction according to which at least one vertical row of locking projections is disposed on the back-rest shell, forming between themselves locking recesses that are open to the side. Further, at least one locking slide is guided on the back-rest support to be displaceable at fight angles to the direction of height adjustment; it engages releasably in one of the locking recesses for fixing a position in height of the back-rest. For the purpose of height adjustment, at least one manually operated actuating slide is guided on the back-rest support for displacement parallel to the direction of height adjustment; it is coupled with the at least one locking slide by way of a tapered sliding transmission.

An advantage of this construction resides in that all the movable parts of the locking mechanism—namely the locking and the actuating slide—are mounted directly on the back-rest support. This permits the pre-assembly of the unit of the back-rest support, locking slide and actuating slide to be produced conveniently, which can then be completed by the back-rest. The transmission coupling the locking slide and the actuating slide provides for the locking of the back-rest to be releasable by simple sliding motion of the actuating slide, which ensures the required ease of handling.

The simple construction explained of the subject matter of the invention provides for the back-rest shell, the back-rest support, the at least one locking slide and the actuating slide to be injection-molded from plastic material and for all the guide elements that ensure the sliding guidance of the afore-mentioned parts to be formed in one piece with the in each case associated parts. This increases the ease of assembly considerably, the individual parts only having to be joined by mutual insertion into the corresponding guide elements. Time-consuming operations, such as screwing or the like, can be omitted.

An especially stable embodiment of the back-rest support, on which great demands are made, is to be substantially H-shaped in cross-section. This cross-sectional configuration renders the back-rest support very rigid statically, the portions defined by the lateral legs of the H and the central leg that connects the latter creating assembly space for the accommodation of the locking mechanism and the actuating slide. Consequently, the adjustable-height back-rest construction according to the invention is very compact.

Further features, details and advantages of the subject matter of the invention will become apparent from the ensuing description of an exemplary embodiment of the invention, taken in conjunction with the drawing.

DESCRIPTION OF THE PREFERRED EMBODIMENT

The attached drawing only shows the adjustable-height back-rest construction of an office chair according to the invention. As for the rest, the office chair may be of any conventional design, for instance having a pedestal provided with castors, an adjustable-height swivel column, a seat support and an upholstered seat placed thereon.

Figure 1:
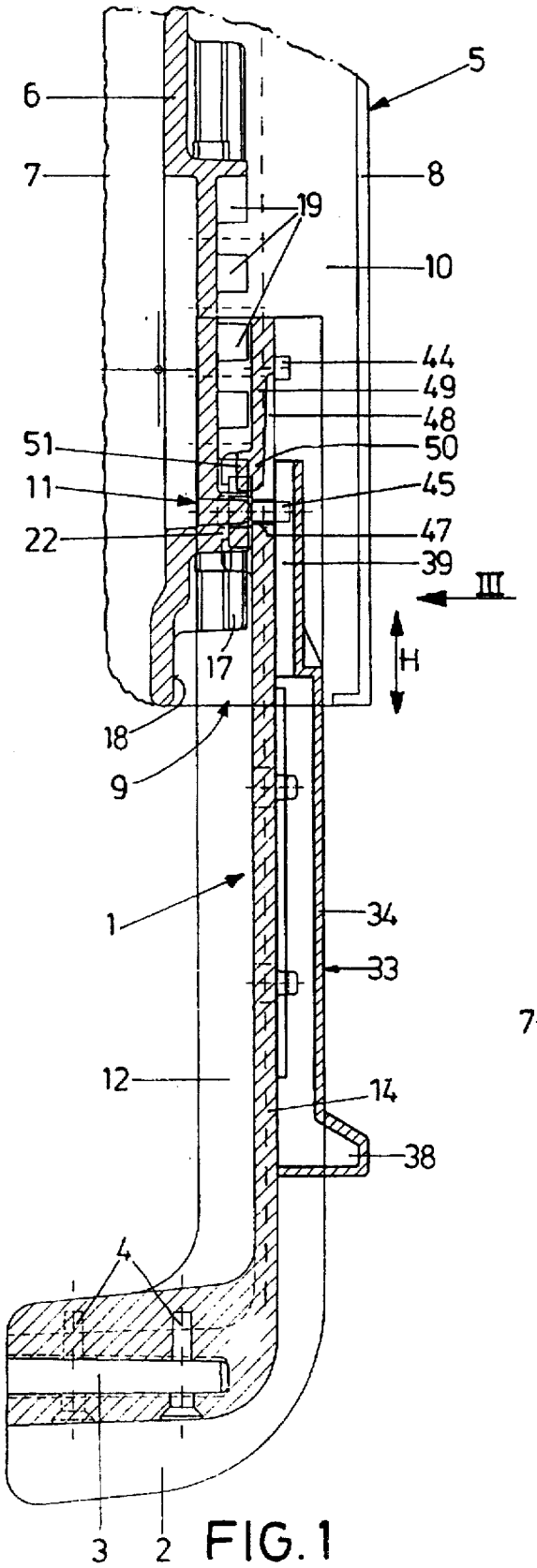
FIG. 1 a vertical section of an adjustable-height back-rest construction placed through the central longidutinal plane of an office chair, with the back-rest in its highest position.
Figure 2:
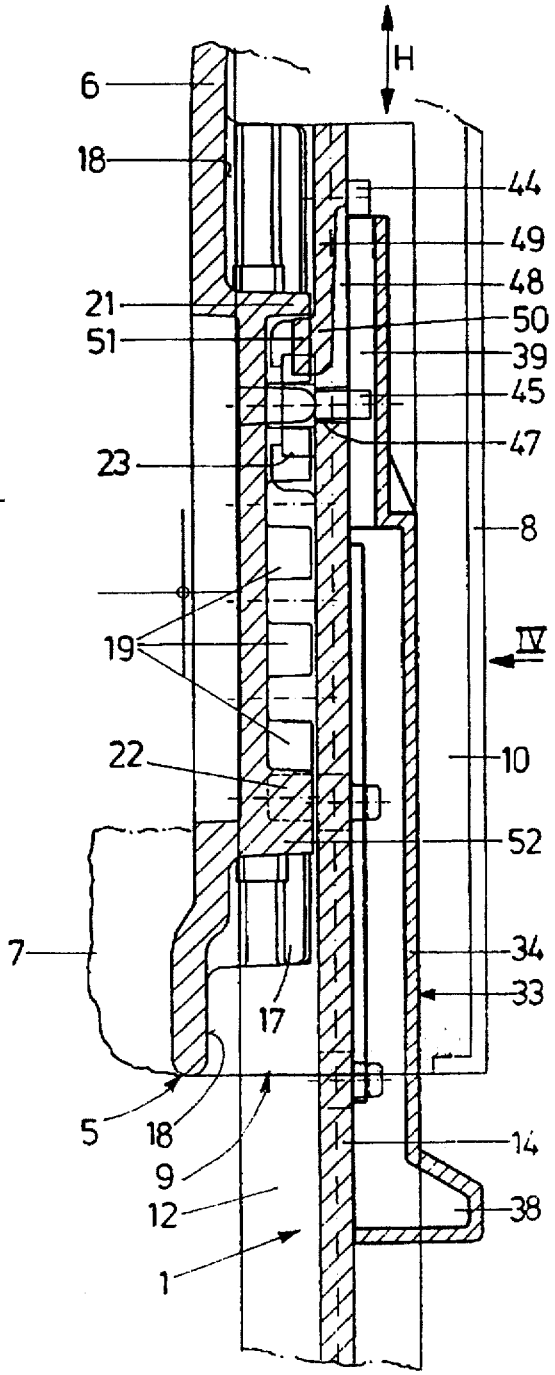
FIG. 2 is a vertical section by analogy to FIG. 1, with the back-rest in its lowest position.

As seen in FIG. 1, the back-rest construction comprises a back-rest support 1 as a supporting member, which is entirely and integrally made from injection-molded plastic material. At its lower end, the vertically extending back-rest support 1 is provided with an elbow 2, in which is incorporated an accommodation 3 for a corresponding fastening element of the seat support (not shown). The drilled holes 4 provided in the elbow 2 and extending vertically and at right angles to the accommodation 3 may take up screws for rigidly joining the back-rest support 1 to the seat support.

A back-rest 5, which is only partially seen in the drawing, is guided vertically displaceably on the back-rest support 1. It consists of a back-rest shell 6 of ergonomic shape, the side of which turned towards the user being provided with an upholstery 7. The rear of the back-rest 5 is provided with a covering shell 8, the back-rest support 1 projecting via an opening 9 between the back-rest shell 6 and covering shell 8 into the interspace 10 between the latter.

A manually actuated locking mechanism denoted in its entirety by 11 is provided between the back-rest support 1 and the back-rest shell 6, for the back-rest shell 6—and consequently the back-rest 5—to be fixed in position of varying height on the back-rest support 1. This locking mechanism 11 still remains to be described in detail below.

Figure 5:
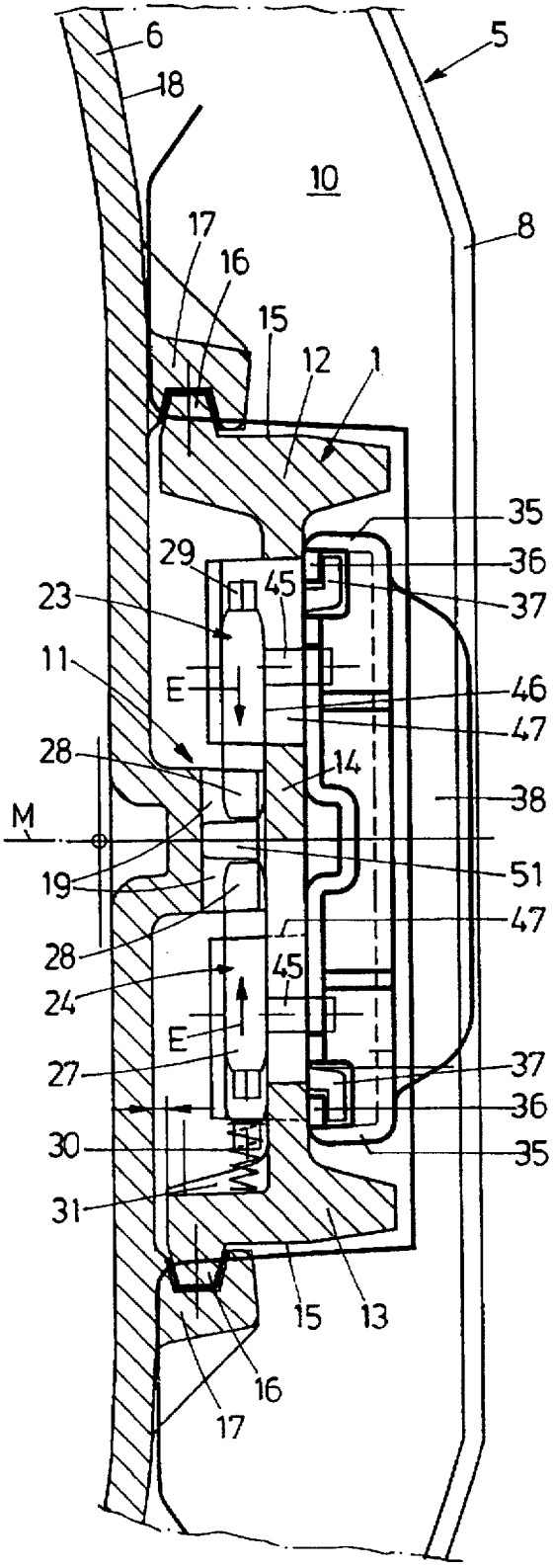
FIG. 5 is a horizontal section through the back-rest construction, taken along the section line V—V of FIG. 4.
Figure 6:
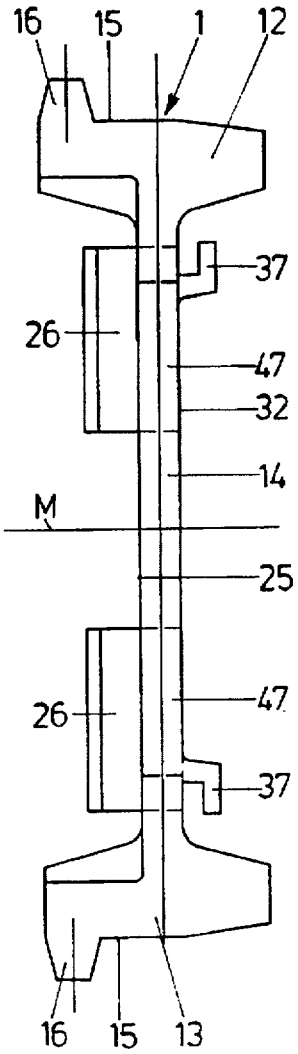
FIG. 6 is a plan view of the back-rest support in the vertical direction.

As seen in FIGS. 5 and 6, the back-rest support 1 has a cross-sectional area in the shape of a flat H referred to a horizontal section plane, two lateral legs 12, 13 of the H extending lengthwise in the vertical direction and a central leg 14 of the H joining the latter. Guide projections 16 projecting outwards are integrally formed on the outsides 15 turned away from each other of the lateral legs 12, 13 on the latter's edge turned towards the back-rest shell 6, guide bars 17 extending in the vertical direction on the back-rest shell 6 enclasping the guide projections 16. The guide bars 17 are integrally formed on the rear 18 of the back-rest shell 6. By the guide projections 16 engaging with the guide bars 17, the back-rest 5 is guided on the back-rest support 1 displaceably in the vertical direction.

For the back-rest 5 to be fixed in a certain position in height on the back-rest support 1, a vertical double row of locking projections 19 is disposed on the rear 18 of the back-rest shell 6, the locking projections 19 forming between them locking recesses 20 that are open laterally. At the upper and lower end of this double row of locking projections 19, provision is further made for projecting stops 21, 22, which delimit the displacement of the back-rest shell 6 on the back-rest support 1 upwards and downwards after the assembly of the back-rest construction in a manner still to be described. The double row of locking projections 19 and the projecting stops 21 and 22 are strictly symmetric to the central longitudinal plane M of the chair.

On the left and right of the double row of locking projections 19 locking slides 23, 24 are disposed on the same level on the back-rest support 1; they are guided displaceably at fight angles to the direction of height adjustment H in bar-type guide angles 26 on the inside 25, turned towards the back-rest shell 6, of the central leg 14 of the H. The locking slides 23, 24 have a flat cuboidal slide body 27, on each side of which turned towards the central longitudinal plane M locking noses 28 are integrally formed. On the rear turned away from the locking nose 28, the slide bodies 27 have centering pins 29 molded on integrally, on which is placed one end of a helical compression spring 30. The other end of the respective helical compression spring 30 supports itself on pocket-type depressions 31 of the respective lateral legs 12, 13 of the H.

The helical compression springs 30 act on the locking slides 23, 24 in the direction towards the central longitudinal plane M—i.e. in the direction of engagement E—so as to secure the position of engagement of the locking noses 28 with the respective locking recesses 20, thus providing for stable fixing in place of the back-rest 5 on the back-rest support 1.

A manually operated actuating slide 33 is provided on the outside 32 of the central leg 14 of the H-shaped back-rest support 1 for actuating the locking mechanism 11 when adjustment in height of the back-rest 5 is desired. The actuating slide 33 comprises a main member 34 in the form of a cuboidal shell, the lateral edges 35 of which being parallel to the direction of height adjustment H and provided with guide ribs 36 that are directed inwards. The latter engage with a pair of hooked guide noses 37 which are disposed on the outside 32 of the central leg 14 of the H-shaped back-rest support 1 at a dear distance referred to the direction of height adjustment H for sufficient guide length to be formed. In the vicinity of its lower end, which projects downwards from the interspace 10 between the back-rest shell 6 and cover 8, the actuating slide 33 comprises an elevation 38 that serves as a handle for operating the actuating slide 33.

At its upper end, the main member 34 is continued by two coupling members 39, 40, which are disposed symmetrically relative to the central longitudinal plane M and the outsides of which turned away from each other are provided with a key taper 41. The two key tapers 41 are oriented so as to form an acute angle that opens downwards. The free end of the coupling members 39, 40 are provided each with a stop leg 42 directed outwards and defining the inside end of the associated key taper 41. A gap 43 is left between the two coupling members 39, 40.

Figure 3:
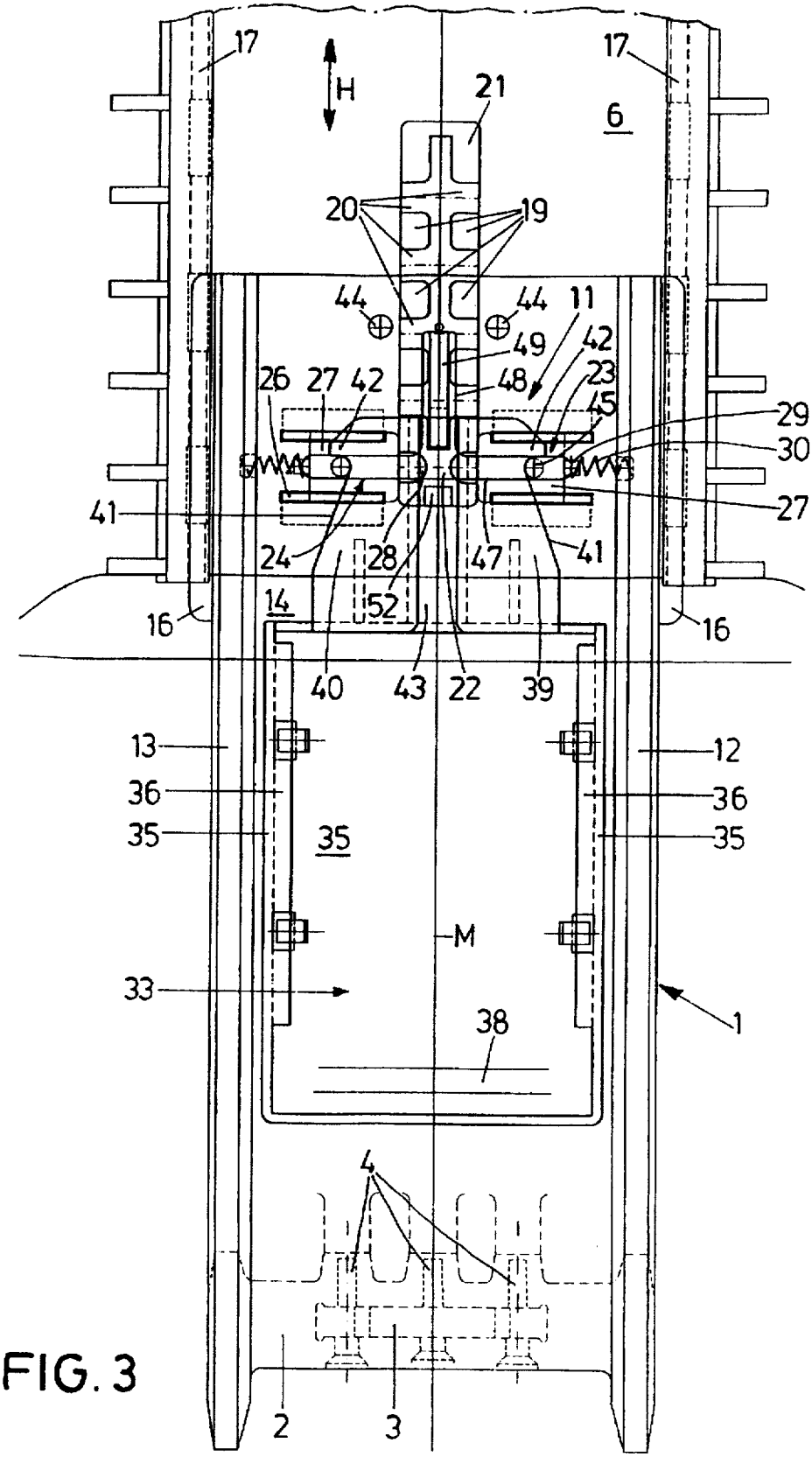
FIG. 3 is a view of the back-rest construction from the direction of the arrow III of FIG. 1.
Figure 4:
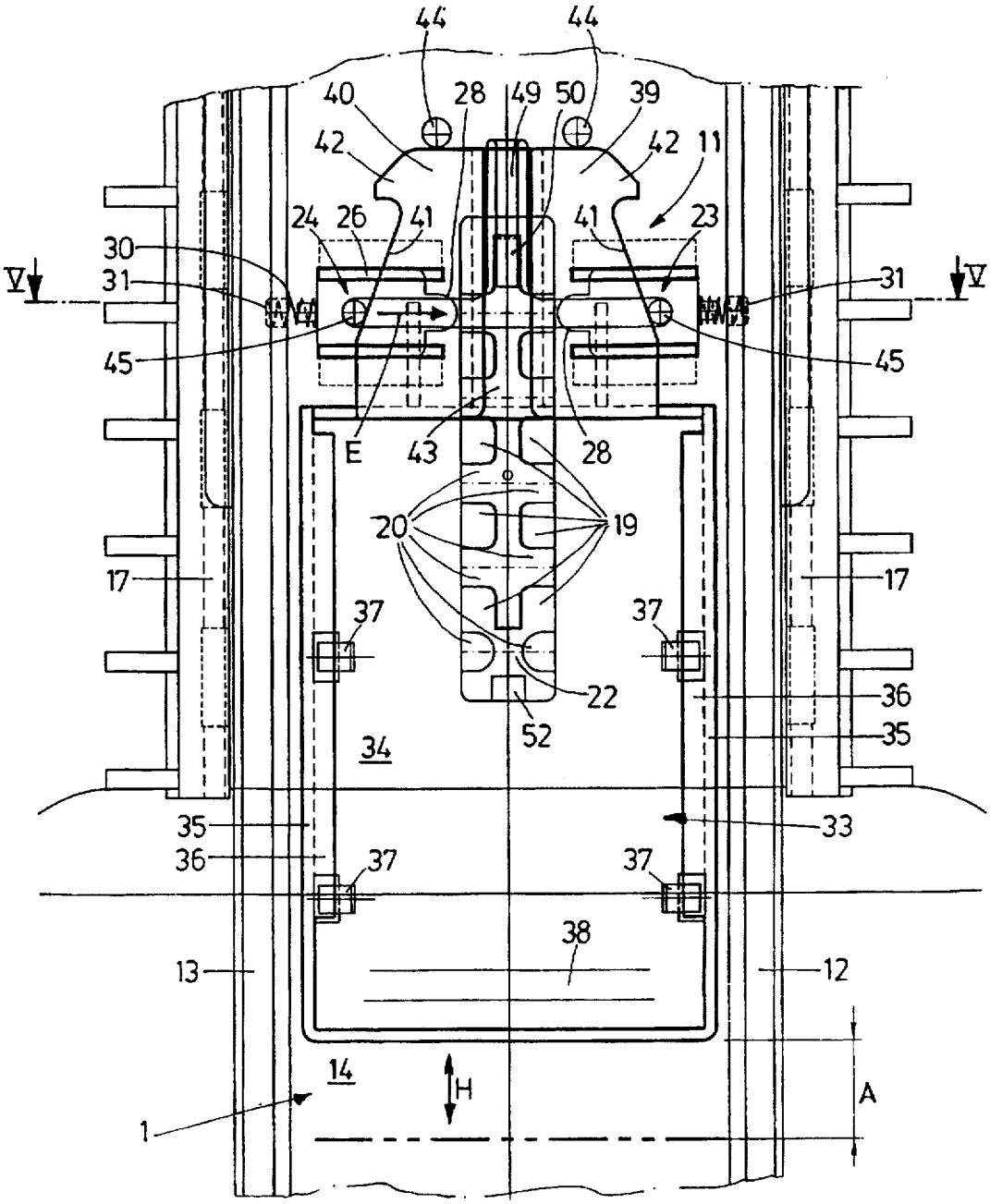
FIG. 4 is a view of the back-rest construction from the direction of the arrow IV of FIG. 2.

The two key tapers 41 are a functional member of the tapered sliding transmission formed between the actuating slide 33 and the locking slides 23, 24. Coupling of these two functional members takes place by a coupling pin 45, which projects over the upper side of the slide body 27, passes through the central leg 14 of the H-shaped back-rest support 1 and is in contact with the associated key taper 41. The passage of the coupling pins 45 of the locking slides 23, 24 takes place through a common recess 47, which extends at right angles to the direction of height adjustment H in the central leg 14 and which has an extension 48 proceeding from its central point upwards in parallel to the direction of height adjustment H. The recess 47 is T-shaped in a plan view (FIGS. 3, 4). A snap-in pin 49 formed integrally on the back-rest support 1 lies in the vicinity of the extension 48, its free end 50 having a swelling 51 which extends from the cross-section of the central leg 14 forwards towards the back-rest shell 6. The swelling 51 thus extends between the two rows of locking projections 19 on the back-rest shell 6. The swelling 51 cooperates with the two projecting stops 21, 22 on the back-rest shell 6 for defining the range of adjustment in height of the back-rest 5.

The functioning of the adjustable-height back-rest construction can be described as follows:

FIG. 3 shows the highest position of the back-rest 5 on the back-rest support 1 by way of example. The actuating slide 33 has been pushed downwards into its position of rest, in which the locking noses 28 of the locking slides 23, 24 engage With the lowermost locking recess 20. The coupling pins 45 of the locking slides 23, 24 rest on the stop legs 42 of the coupling members 39, 40, through which the position of rest of the actuating slide 33 is defined simultaneously.

For height adjustment of the back-rest 5, the actuating slide 33 is pushed upwards by the actuating path A (FIG. 4), which is defined by the stop pins 44 formed on the back-rest support 1 above the coupling members 39, 40. By way of the transmission of the key tapers 41 coupled with the coupling pins 45, the locking slides 23, 24 are forced outwards so that their locking noses 28 are moved out of the locking recesses 20.

Then the back-rest 5 can for instance be moved into the lowermost position shown in FIG. 4—or into one of the locking positions defined by the locking recesses disposed in between. By pushing the actuating slide 33 back into its position of rest (FIG. 3), the locking slides 23, 24 are moved inwards under the action of the helical compression springs 30 so that their locking noses 28 again penetrate into the corresponding locking recesses 20.

The following has to be noted for the assembly of the adjustable-height back-rest construction:

First the back-rest support 1, the actuating slide 33 and the locking slides 23, 24 inclusive of the helical compression spring 30 can be pre-assembled completely for a configuration to result as seen in FIG. 3. The back-rest 5 only has to be slipped on for the purpose of assembly and the actuating slide 33 must be operated. The underside of the lower projecting stop 22 on the back-rest shell 6 will bear against the swelling 51 of the snap-in pin 49. For the snap-in pin 49 to be guided more easily over and beyond the projecting stop 22, the underside of the latter is provided with a sloping 52. As soon as the snap-in pin 49 penetrates into the area between the projecting stops 21, 22 and the locking projections 19, the back-rest 5 is secured against any inadvertent removal.

For dismantling the back-rest 5, only the latter's covering shell 8 has to be removed and the snap-in pin 49 must be withdrawn backwards by a suitable tool. Then the locking mechanism 11 can be actuated by operation of the actuating slide, and the back-rest 5 can be withdrawn upwards.

Finally, attention is drawn to the fact that the back-rest shell 6, the back-rest support 1, the locking slides 23, 24 and the actuating slide 33, inclusive of all their guide elements, stops, projections and the like, are made in one piece of injection-molded plastics so that the adjustable-height back-rest construction can do with the lowest number conceivable of component parts.

What is claimed is:

1. A chair for an office having an adjustable-height back-rest construction, comprising:

a vertical back-rest support (1) fixed to a chair stand, a back-rest (5) guided on the back-rest support (1) for vertical height adjustment and having a back-rest shell (6), and a manually operated locking mechanism (11) acting between the back-rest support (1) and the back-rest shell (6) for the back-rest shell (6) to be fixed in place on the back-rest support (1) in various vertical positions, wherein at least one vertical row of locking projections (19) is disposed on the back-rest shell (6), forming locking recesses (20) between said locking projections, wherein at least one locking slide (23,24) is guided on the back-rest support (1) for horizontal displacement, and releasably engages with one of the locking recesses (20) for fixing the back-rest (5) in a vertical position, wherein a manually operated actuating slide (33) is guided on the back-rest support (1) for vertical displacement, the actuating slide (33) being coupled with at least one of said locking slides (23,24) by way of a tapered sliding transmission (41,45), wherein the back-rest support (1) has two lateral legs and a cross-section of a substantially flat H-shape, wherein guide projections (16) are formed on the outside (15) of the lateral legs (12,13) of the H-shaped back-rest support (1), and with guide bars (17) extending in the vertical direction on the back-rest shell (6) and enclapsing the guide projections (16), and wherein on the outside (32) of a central leg (14) of the H-shaped back-rest support (1), the actuating slide (33) is displaceably guided on the back-rest support (1) by means of hooked guide noses (37), and guide ribs (36) projecting inwardly to said hooked guide noses and extending on the actuating slide (33).

2. A chair according to claim 1, wherein the back-rest support (1), the back-rest shell (6), said at least one locking slide (23, 24) and the actuating slide (33) are plastic injection-molded, wherein said back-rest support (1), said back-rest shell (6) and said at least one locking slide (23, 24) comprises guide elements (16, 17, 26, 36, 37) for mutually sliding said back-rest support (1), said back-rest shell (6) and said at least one locking slide (23, 24); and said guide elements (16, 17, 26, 36, 37) being formed in a single piece integrally with one of said back-rest support (1), said back-rest shell (6) and said at least one locking slide (23, 24).

3. A chair according to claim 1, wherein two rows of said locking recesses (20) are provided side by side, with an associated locking slide (23, 24) engaging therewith from the outside, said locking slides being actuatable by said actuating slide (33) via two of said key tapers (41) turned away from each other.

4. A chair for an office having an adjustable-height back-rest construction, comprising:

a vertical back-rest support (1) fixed to a chair stand, a back-rest (5) guided on the back-rest support (1) for vertical height adjustment and having a back-rest shell (6), and a manually operated locking mechanism (11) acting between the back-rest support (1) and the back-rest shell (6) for the back-rest shell (6) to be fixed in place on the back-rest support (1) in various vertical positions, wherein at least one vertical row of locking projections (19) is disposed on the back-rest shell (6), forming locking recesses (20) between said locking projections, wherein at least one locking slide (23,24) is guided on the back-rest support (1) for horizontal displacement, and releasably engages with one of the locking recesses (20) for fixing the back-rest (5) in a vertical position, wherein a manually operated actuating slide (33) is guided on the back-rest support (1) for vertical displacement, the actuating slide (33) being coupled with at least one of said locking slides (23,24) by way of a tapered sliding transmission (41,45), wherein the back-rest support (1) has two lateral legs and a cross-section of a substantially flat H-shape, wherein on an inside (25) of the back-rest shell (6) of a central leg (14) of the H-shaped back-rest support (1), said at least one locking slide (23,24) is guided for horizontal displacement in between a pair of bar-type guide angles (26) on the back-rest support (1).

5. A chair according to claim 4, wherein the back-rest support (1) the back-rest shell (6) said at least one locking slide (23, 24) and the actuating slide (33) are plastic injection-molded, wherein said back-rest support (1), said back-rest shell (6) and said at least one locking slide (23, 24) comprises guide elements (16, 17, 26, 36, 37) for mutually sliding of said back-rest support (1), said back-rest shell (6) and said at least one locking slide (23, 24); and said guide elements (16, 17, 26, 36, 37) being formed in a single piece integrally with one of said back-rest support (1), said back-rest shell (6) and said at least one locking slide (23, 24).

6. A chair according to claim 4, wherein two rows of said locking recesses (20) are provided side by side, with two associated locking slide (23, 24) engaging therewith from the outside, said both locking slides being actuatable by a common actuating slide (33) having two key tapers (41) on opposite sides of said actuating slide (33).

7. A chair according to claim 4, wherein said at least one locking slide (23, 24) has a flat cuboidal slide body (27) having a coupling pin (45) which passes through the central leg (14) of the H shaped back-rest support and is in contact with a key taper (41) on the actuating slide (33).

8. A chair according to claim 7, wherein said at least one locking slide (23, 24) is acted upon in a direction of engagement (E) with the locking recesses (20) of the back-rest shell (6) by a helical compression spring (30) supporting itself on the lateral leg (12, 13) of the H shaped back-rest support.

9. A chair according to claim 7, wherein an inside end of the key taper (41) is defined by a stop leg (42).

10. A chair for an office having an adjustable-height back-rest construction, comprising:

a vertical back-rest support (1) fixed to a chair stand, a back-rest (5) guided on the back-rest support (1) for vertical height adjustment and having a back-rest shell (6), and a manually operated locking mechanism (11) acting between the back-rest support (1) and the back-rest shell (6) for the back-rest shell (6) to be fixed in place on the back-rest support (1) in various vertical positions, wherein at least one vertical row of locking projections (19) is disposed on the back-rest shell (6), forming locking recesses (20) between said locking projections, wherein at least one locking slide (23,24) is guided on the back-rest support (1) for horizontal displacement, and releasably engages with one of the locking recesses (20) for fixing the back-rest (5) in a vertical position, wherein a manually operated actuating slide (33) is guided on the back-rest support (1) for vertical displacement, the actuating slide (33) being coupled with at least one of said locking slides (23,24) by way of a tapered sliding transmission (41,45), wherein a snap-in pin (49) is integrally formed on the back-rest support (1), cooperating with two stops (21, 22) on the back-rest shell (6) for defining the vertical adjustment range of the back-rest (5).

11. A chair according to claim 10, wherein the back-rest support (1), the back-rest shell (6), said at least one locking slide (23, 24) and the actuating slide (33) are plastic injection-molded, wherein said back-rest support (1), said back-rest shell (6) and said at least one locking slide (23, 24) comprise guide elements (16, 17, 26, 36, 37) for mutually sliding of said back-rest support (1), said back-rest shell (6) and said at least one locking slide (23, 24); and said guide elements (16, 17, 26, 36, 37) being formed in a single piece integrally with one of said back-rest support (1), said back-rest shell (6) and said at least one locking slide (23, 24).

12. A chair according to claim 10, wherein two rows of said locking recesses (20) are provided side by side, with two associated locking slide (23, 24) engaging therewith from the outside, said both locking slides being actuatable by a common actuating slide (33) having two key tapers (41) on opposite sides of said actuating slide (33).

* * * * *